US005795662A

United States Patent [19]

Maezono et al.

[11] Patent Number: 5,795,662

[45] Date of Patent: Aug. 18, 1998

[54] ZINCATE-TREATED ARTICLE OF AL-MG-SI BASE ALLOY AND METHOD OF MANUFACTURING THE SAME

[75] Inventors: Shunichiro Maezono; Makoto Tawara; Kikuo Toyose, all of Moka, Japan

[73] Assignee: Kobe Alcoa Transportation Products Ltd., Tokyo, Japan

[21] Appl. No.: 628,518

[22] Filed: Apr. 5, 1996

[30] Foreign Application Priority Data

Apr. 7, 1995 [JP] Japan ..... 7-108264

[51] Int. Cl.[6] ..... B32B 15/20; C23C 22/66

[52] U.S. Cl. ..... 428/650; 428/658; 428/936; 427/437

[58] Field of Search ..... 428/650, 658, 428/936; 427/436, 437

[56] References Cited

U.S. PATENT DOCUMENTS

| | | | |
|---|---|---|---|
| 3,671,406 | 6/1972 | Mattia et al. | 205/114 |
| 3,760,238 | 9/1973 | Hamer et al. | 257/736 |
| 3,905,776 | 9/1975 | Long et al. | 428/673 |
| 3,969,199 | 7/1976 | Berdan et al. | 205/177 |
| 4,088,544 | 5/1978 | Hutkin | 428/545 |
| 4,840,820 | 6/1989 | Schultz et al. | 427/438 |

*Primary Examiner*—John J. Zimmerman

*Attorney, Agent, or Firm*—Oblon, Spivak, McClelland, Maier & Neustadt, P.C.

[57] ABSTRACT

A zincate-treated article of an Al-Mg-Si base alloy has a zincate coating film having a Zn crystal grain size of 1.0 μm or smaller on an Al-Mg-Si base alloy body having a Cu content of 0.1 to 1.5 weight %. The Zn crystal grain size is preferably equal to or smaller than 0.95 μm. This zincate-treated article can be manufactured by treating an Al-Mg-Si base alloy body having a Cu content of 0.1 to 1.5 weight % in a zincating treatment bath containing 100 to 300 g/l of sodium hydroxide, 5 to 20 g/l of zinc oxide, 2 to 10 g/l of iron chloride, 5 to 20 g/l of Rochelle salt and 50 to 200 ml/l of water glass at a temperature of 20° to 80° C. for 5 to 60 seconds. By adjusting the Zn crystal grain size in the zincating treatment in this manner, a zincate-treated article of an Al-Mg-Si base alloy having an excellent adhesion can be acquired even in a single stage zincating treatment.

4 Claims, 1 Drawing Sheet

ZINCATE-TREATED ARTICLE OF AL-MG-SI BASE ALLOY AND METHOD OF MANUFACTURING THE SAME

BACKGROUND OF THE INVENTION

1. Field of the Invention

The present invention relates to a zincate-treated article of an Al-Mg-Si base alloy subjected to a single stage zincating treatment and a method of manufacturing the same, and, more particularly, to a zincate-treated article of an Al-Mg-Si base alloy suitable as an automobile panel member which is to be subjected to a zinc phosphating treatment and a method of manufacturing the same.

2. Description of the Related Art

Aluminum alloys are positively being used as automobile parts for the purpose of reducing the weight, and are used for outer plates such as the roof and hood for some types of cars. As aluminum alloys for automobile panels, an Al-Mg-Si base alloy is mainly used in Europe while an Al-Mg base alloy is mainly used in Japan. While the Al-Mg-Si base alloy has such excellent properties for the panel members of automobiles as having a high strength after baking finish and, unlike the Al-Mg base alloy, causing no SS marks, the Al-Mg-Si base alloy hardly causes the deposition of zinc phosphate. A zincating treatment is locally performed on the Al-Mg base alloy in order to improve the zinc phosphating property, whereas no zincating treatment is performed on the Al-Mg-Si base alloy. It should however be noted that a chromate treatment may be performed on this Al-Mg-Si base alloy to improve its corrosion resistance. The low adhesion of the zincate coating is one reason why a zincate-treated article of an Al-Mg-Si base alloy is not used.

Observing the Zn crystal of the Al-Mg-Si base alloy which has poor adhesion, the present inventors confirmed that the grain size of the crystal exceeded 1.0 μm.

Today, a zinc phosphating treatment for the aluminum alloy is performed at the same time as for the steel in the chemical conversion coating, and an aluminum alloy, which is electrically a more base metal than steel, has a difficulty in causing the deposition of zinc phosphate in the neighborhood of steel, thus degrading the thread rust resistance. For the use of an aluminum alloy for automobile panels having zinc phosphate film as the underlying material for painting, it is necessary to consider the surface treatment.

As one example of the surface treatment to progress the deposition of zinc phosphate, a method of applying Zn plating to the surface of a target article has been proposed in, for example, Unexamined Japanese Patent Publication No. Sho 61-157693. More specifically, this prior art employs electroplating and hot dipping as examples.

A known way of plating a Zn layer on the surface of an aluminum alloy is the chemical displacement plating (zincating) treatment which is normally executed as the pre-treatment before the electroplating. While one example of the composition of the current zincating treatment bath includes sodium hydroxide, zinc oxide, iron chloride and Rochelle salt, the adhesion of the coating is insufficient in the conventional zincating treatment. To improve the adhesion of the coating, there is a method of carrying out degreasing, then nitrate washing, then first stage zincating, then nitrate separation and then second stage zincating, as described below. This method however involves complicated steps and needs washing with water between steps, and is not thus preferable from the industrial viewpoint.

The formation of a coating of zincating on the aluminum surface is disclosed in U.S. Pat. No. 4,888,218, U.S. Pat. No. 5,429,881 and U.S. Pat. No. 5,389,453.

U.S. Pat. No. 4,888,218 teaches the art of using zinc fluoride as a zincating treatment bath, and suffers the generation of contamination due to the use of fluoride.

U.S. Pat. No. 5,429,881 and U.S. Pat. No. 5,389,453 describe Fe and $SiO_2$ being contained as the compositions of the coating in view of the compositions of a zincate coating. Those two publications however neither teach nor suggest the crystal grain size of the coating.

As discussed above, while the zinc phosphating property can be improved by forming a coating of a Zn base metal (zincate) on the surface of an Al-Mg-Si base alloy, the prior arts are insufficient to improve the adhesion of zincate coatings of all Al-Mg-Si base alloys so that the coating is separated at the time of executing the treatment or pressing, thus resulting in insufficient corrosion resistance. The conventional means of improving the adhesion of the coating involves a complicated step which is industrially undesirable.

SUMMARY OF THE INVENTION

Accordingly, it is an object of the present invention to provide a zincate-treated article of an Al-Mg-Si base alloy having an excellent adhesion even in a single stage zincating treatment by adjusting the grain size of Zn crystal in the zincating treatment and a method of manufacturing the same.

A zincate-treated article of an Al-Mg-Si base alloy according to one aspect of this invention comprises:

an Al-Mg-Si base alloy body having a Cu content of 0.1 to 1.5 weight %; and a zincate coating film having a Zn crystal grain size of 1.0 μm or smaller.

It is preferable that the Zn crystal grain size be equal to or smaller than 0.95 μm.

A method of manufacturing a zincate-treated article of an Al-Mg-Si base alloy according to another aspect of this invention comprises the step of:

treating an Al-Mg-Si base alloy body having a Cu content of 0.1 to 1.5 weight % in a zincating treatment bath containing 100 to 300 g/l of sodium hydroxide, 5 to 20 g/l of zinc oxide, 2 to 10 g/l of iron chloride, 5 to 20 g/l of Rochelle salt and 50 to 200 ml/l of water glass at a temperature of 20° to 80° C. for 5 to 60 seconds.

The present inventors conducted various experiments and studies to overcome the aforementioned problems of the prior arts, and found that a zincate-treated article of an Al-Mg-Si base alloy having an excellent adhesion can be acquired by using an Al-Mg-Si base alloy body having a Cu content of 0.1 to 1.5 weight % as an underlying material of the zincate-treating and having a Zn crystal grain size of 1.0 μm or smaller in the zincate coating film. The Zn crystal grain size is preferably equal to or smaller than 0.95 μm. This zincate-treated article can be manufactured by treating this Al-Mg-Si base alloy body in a zincating treatment bath containing 100 to 300 g/l of sodium hydroxide, 5 to 20 g/l of zinc oxide, 2 to 10 g/l of iron chloride, 5 to 20 g/l of Rochelle salt and 50 to 200 ml/l of water glass at a temperature of 20° to 80° C. for 5 seconds to one minute to ensure the Zn crystal grain size of 1.0 μm or smaller.

In other words, the present inventors found out that the Zn crystal grain size is closely associated with the adhesion of the zincate coating, and also found through the experiments and studies that the adhesion of the coating formed in the single zincating treatment could be improved significantly by adjusting the Zn crystal grain size to 1.0 μm or smaller with respect to the Al-Mg-Si base alloy.

This invention has been completed based on such knowledge. It is the subject matter of this invention to control the Zn crystal grain size within a specified range in the zincating treatment of an Al-Mg-Si base alloy.

As this invention can form a zincate coating film having an excellent adhesion in a single zincating treatment with respect to an Al-Mg-Si base alloy, the invention has an excellent zinc phosphating property and a considerably improved thread rust resistance.

DETAILED DESCRIPTION OF THE PREFERRED EMBODIMENT

Figure 1A:
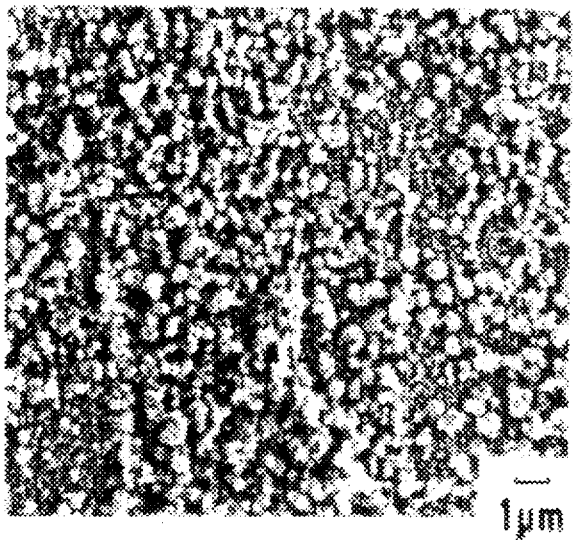
FIG. 1(A) and FIG. 1(B) are photograph) photographs of a metallographic structure showing the Zn crystal grain sizes of an example No. 6 of this invention and a comparative example No. 21 given in Table 3.

Under the following conditions, a uniform chemical reaction occurs so that uniform and fine Zn crystal is produced. The reasons for the numeral restriction under each condition will be discussed below.

Zn Crystal Grain Size

The Zn crystal grain size is set to 1.0 μm or smaller because the grain size greater than this range makes the adhesion of a zincate coating poorer.

Cu Content of Al-Mg-Si Base Alloy

The reason why the Cu content of the Al-Mg-Si base alloy is set to 0.1 to 1.5 weight % is that the Cu content of less than 0.1 weight % degrading the adhesion of the zincate coating while the Cu content of above 1.5 weight % suppresses the zincating treatability too much and thus takes more time for the deposition of the proper amount of zincate, which is industrially undesirable. Preferably, the Cu content should lie within the range of 0.3 to 1.0 weight %. It is more preferable that the Cu content be in the range of 0.4 to 1.0 weight %. The Cu content exceeding 1.5 weight % considerably reduce the corrosion resistance. Although the mechanism of the effect of adding Cu is not yet clarified, one possible explanatiòn is that the Cu deposit triggers the generation of hydrogen so that fine Zn crystal adheres, thus contributing to the improvement of the adhesion of the zincate coating.

Zincating Treatment Temperature

The lower limit of the temperature of the zincating treatment bath is set to 20° C. because at a lower temperature than that, the deposition of the proper amount of zincate takes time, which is industrially undesirable. The reason for the higher temperature limit being set to 80° C. is that at a higher temperature than that, the adhesion of the zincate coating becomes poor.

Composition of Zincate Bath

The amount of sodium hydroxide in the zincating treatment bath is set to 100 g/l or greater and 300 g/l or smaller because sodium hydroxide of less than 100 g/l impairs the reactivity while sodium hydroxide of greater than 300 g/l causes the liquid dropping.

The reason why the amount of zinc oxide is set to 5 g/l or above and 20 g/l or smaller is that zinc oxide of less than 5 g/l or greater than 20 g/l results in porous plating.

The reason why the amount of iron chloride is set to 2 g/l or greater and 10 g/l or smaller is that iron chloride of less than 2 g/l results in poor adhesion while iron chloride of greater than 10 g/l results in prominent unevenness.

The amount of Rochelle salt is set equal to or greater than 5 g/l and equal to or smaller than 20 g/l because Rochelle salt of less than 5 g/l results in poor adhesion while Rochelle salt of greater than 20 g/l results in prominent unevenness.

The amount of water glass is set equal to or greater than 50 ml/l and equal to or less than 200 ml/l because water glass of less than 50 ml/l degrades the adhesion while water glass of greater than 200 ml/l impairs the reactivity. Although the mechanism of the effect of water glass on the alloy is not yet clear, one possible explanation is that the suppression of the zincate reaction produces many Zn crystal nuclei, which contribute to the improvement of the adhesion of the zincate coating.

The following will discuss the advantages of this invention by comparing zincate-treated articles according to examples of this invention with zincate-treated articles of comparative examples.

Ingots with a thickness of 50 mm are acquired. Firstly, aluminum alloys having the chemical compositions shown in Table 1 are melted and then casted. The resultant ingots were subjected to a homogenizing treatment at 510° C. for four hours, and then hot-rolled at 480° C. to obtain hot-rolled plates having a thickness of 5 mm. After the hot-rolling, the hot-rolled plates were left to have a room temperature. Then, they were subjected to cold rolling at the room temperature to obtain cold-rolled plates having a thickness of 1 mm, and a solution treatment was then performed by heating the cold-rolled plates to 530° C. at a rate of 850° C./hour and holding the plates at 530° C. for 30 seconds. Then, hardening was executed to obtain plates of JIS T4-treatment, which were used in the experiments.

The thus manufactured aluminum alloy materials were subjected to a zincating treatment using the zincate bath compositions as given in Table 2. In this zincating treatment, the aluminum alloy materials were degreased first, and were then subjected to nitrate washing. After the nitrate washing, the aluminum alloy bodies were subjected to a zincating treatment, washed with water and then dried. Thereafter, the amount of each adhered zincate coating was measured by means of nitrate separation, the adhesion was evaluated by tape peeling, and the Zn crystal grain size was measured by SEM observation. The results are shown on Table 3 given below.

In Table 3, the numerals "1" to "5," representing the degrees of the adhesion evaluated, are classified based on the peel area of the zincate coating.

Figure 1B:
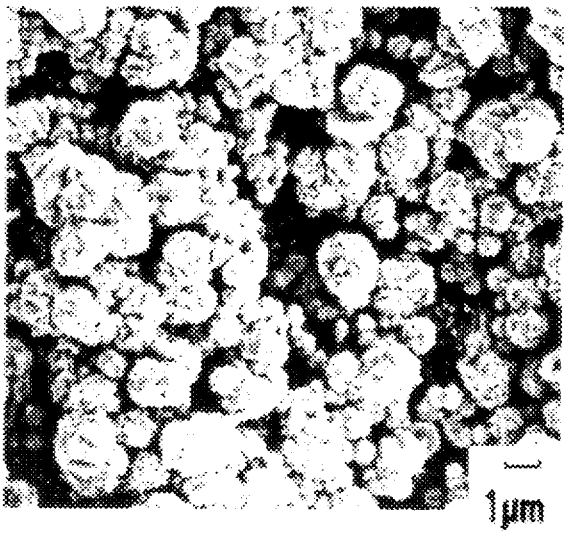

5: 0% peeling
4: peeling of 5% or less
3: peeling of 5 to 20%
2: peeling of 20 to 50%
1: peeling of 50% or above The Zn crystal grain sizes of the example No. 6 and the comparative example No. 21 given in Table 3 are shown in the photographs of metallographic structures in FIG. 1(A) and FIG. 1(B).

TABLE 1

Chemical Composition of Al Alloy (Weight %)

| No. | Si | Mg | Cu | Al |
|---|---|---|---|---|
| Examples | | | | |
| 1 | 1.0 | 0.3 | 0.15 | remainder |
| 2 | 1.0 | 0.3 | 0.35 | remainder |
| 3 | 1.0 | 0.8 | 0.60 | remainder |
| 4 | 1.0 | 0.5 | 0.95 | remainder |
| 5 | 1.0 | 0.8 | 1.45 | remainder |

TABLE 1-continued

| Chemical Composition of Al Alloy (Weight %) | | | | |
|---|---|---|---|---|
| No. | Si | Mg | Cu | Al |
| Com. Ex. | | | | |
| 6 | 1.0 | 0.3 | 0.01 | remainder |
| 7 | 1.0 | 0.8 | 0.05 | remainder |
| 8 | 1.0 | 0.5 | 1.60 | remainder |
| 9 | 1.0 | 0.8 | 2.25 | remainder |

TABLE 2

| No. | Sodium Hydroxide (g/l) | Zinc Chloride (g/l) | Iron Chloride (g/l) | Rochelle Salt (g/l) | Water Glass (mg/l) |
|---|---|---|---|---|---|
| Examples | | | | | |
| A | 100 | 10 | 2 | 20 | 50 |
| B | 200 | 5 | 10 | 10 | 200 |
| C | 200 | 10 | 5 | 10 | 100 |
| D | 200 | 20 | 5 | 5 | 100 |
| E | 300 | 10 | 10 | 10 | 100 |
| Pr. Art | | | | | |
| S | 200 | 10 | 5 | 10 | 0 |
| Com. Ex. | | | | | |
| X | 200 | 10 | 5 | 10 | 300 |
| Y | 200 | 10 | 5 | 2 | 100 |
| Z | 200 | 10 | 0.5 | 10 | 100 |

TABLE 3

| No. | Alloy No. | Treat-ment Bath | Bath Temp. (°C.) | Treat-ment time (sec) | Amount of Zin Zincate Coating (g/m²) | Grain Size of Zn Crystal (μm) | Adhe-sion |
|---|---|---|---|---|---|---|---|
| Exam-ples | | | | | | | |
| 1 | 1 | C | 40 | 10 | 1.53 | 0.95 | 4 |
| 2 | 2 | C | 40 | 10 | 1.24 | 0.78 | 5 |
| 3 | 3 | C | 40 | 10 | 1.08 | 0.62 | 5 |
| 4 | 4 | A | 40 | 10 | 1.00 | 0.39 | 4 |
| 5 | 4 | B | 40 | 10 | 0.80 | 0.42 | 5 |
| 6 | 4 | C | 40 | 10 | 0.92 | 0.41 | 5 |
| 7 | 4 | D | 40 | 10 | 0.93 | 0.44 | 4 |
| 8 | 4 | E | 40 | 10 | 0.95 | 0.39 | 5 |
| 9 | 4 | C | 25 | 10 | 0.85 | 0.39 | 5 |
| 10 | 4 | C | 60 | 10 | 1.01 | 0.95 | 5 |
| 11 | 4 | C | 75 | 10 | 1.12 | 0.95 | 5 |
| 12 | 4 | C | 40 | 30 | 1.02 | 0.95 | 5 |
| 13 | 4 | C | 40 | 55 | 1.52 | 0.95 | 5 |
| 14 | 5 | C | 40 | 10 | 0.80 | 0.95 | 5 |
| Com. Exam-ples | | | | | | | |
| 15 | 4 | S | 40 | 10 | 1.83 | 1.40 | 3 |
| 16 | 4 | x | 40 | 10 | 0.68 | 0.32 | 5 |
| 17 | 4 | Y | 40 | 10 | 1.65 | 1.65 | 1 |
| 18 | 4 | Z | 40 | 10 | 1.75 | 1.28 | 1 |

TABLE 3-continued

| No. | Alloy No. | Treat-ment Bath | Bath Temp. (°C.) | Treat-ment time (sec) | Amount of Zin Zincate Coating (g/m²) | Grain Size of Zn Crystal (μm) | Adhe-sion |
|---|---|---|---|---|---|---|---|
| 19 | 6 | C | 40 | 10 | 2.31 | 2.04 | 1 |
| 20 | 7 | A | 40 | 10 | 1.95 | 1.25 | 1 |
| 21 | 7 | C | 40 | 10 | 1.82 | 1.32 | 1 |
| 22 | 7 | D | 40 | 10 | 1.85 | 1.28 | 1 |
| 23 | 7 | C | 15 | 10 | 1.60 | 1.28 | 2 |
| 24 | 7 | C | 75 | 10 | 2.03 | 1.65 | 1 |
| 25 | 7 | C | 40 | 2 | 1.76 | 1.30 | 1 |
| 26 | 7 | C | 40 | 55 | 2.83 | 1.41 | 1 |
| 27 | 8 | C | 40 | 10 | 1.70 | 0.31 | 5 |
| 28 | 9 | C | 40 | 10 | 0.68 | 0.30 | 5 |

As is apparent from Table 3, the Zn crystal grain sizes of the zincate coating of the alloys of the examples of this invention are equal to or smaller than 1 μm, the adhesion of the zincate coatings is superb, whereas the alloys of the comparative examples which have Zn crystal grain sizes of over 1 μm (comparative examples 15, 17 to 18 and 19 to 26) have poor adhesion. Further, the alloys of the comparative examples (15 and 17 to 18) using zincating treatment baths which are off the specified range of this invention (zincating treatment baths S and X to Z) also have poor adhesion. Moreover, the comparative examples 16, 27 and 28 suffer an insufficient amount of the zincate coating.

In short, because this invention can form a zincate coating having an excellent adhesion in a single zincating treatment with respect to an Al-Mg-Si base alloy, the invention has an excellent zinc phosphating property and a considerably improved thread rust resistance.

What is claimed is:

1. A zincate-treated article of an aluminum-based alloy comprising:

an aluminum-based alloy body containing Mg, Si and 0.1 to 1.5 weight % Cu; and a zincate coating film having a Zn crystal grain size of 1.0 μm or smaller.

2. The zincate-treated article according to claim 1, wherein said Zn crystal grain size is equal to or smaller than 0.95 μm.

3. A method of manufacturing a zincate-treated article of an aluminum-based alloy comprising the step of:

treating aluminum-based alloy body containing Mg, Si and 0.1 to 1.5 weight % Cu in a zincating treatment bath containing 100 to 300 g/l of sodium hydroxide, 5 to 20 g/l of zinc oxide, 2 to 10 g/l of iron chloride, 5 to 20 g/l of Rochelle salt and 50 to 200 ml/l of water glass at a temperature of 20° to 80° C. for 5 to 60 seconds.

4. A zincate-treated article produced by the method of claim 3.

* * * * *